US008991553B2

(12) United States Patent
Wakatsuki et al.

(10) Patent No.: US 8,991,553 B2
(45) Date of Patent: Mar. 31, 2015

(54) SILENCING APPARATUS FOR VEHICLE

(75) Inventors: Kazutoshi Wakatsuki, Toyota (JP); Nakaya Takagaki, Toyota (JP); Hideyuki Komitsu, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/993,876

(22) PCT Filed: Dec. 15, 2011

(86) PCT No.: PCT/IB2011/003054

§ 371 (c)(1),
(2), (4) Date: Jun. 13, 2013

(87) PCT Pub. No.: WO2012/085636

PCT Pub. Date: Jun. 28, 2012

(65) Prior Publication Data

US 2013/0270034 A1 Oct. 17, 2013

(30) Foreign Application Priority Data

Dec. 24, 2010 (JP) ..... 2010-287468

(51) Int. Cl.
*F01N 1/08* (2006.01)
*F01N 1/02* (2006.01)

(52) U.S. Cl.
CPC .. *F01N 1/08* (2013.01); *F01N 1/02* (2013.01); *F01N 1/083* (2013.01); *F01N 1/084* (2013.01); *F01N 1/089* (2013.01)
USPC ..... 181/268; 181/272; 181/275

(58) Field of Classification Search
CPC F01N 1/083; F01N 2490/06; F01N 2490/155
USPC ..... 181/251, 253, 254, 257, 264, 265, 268, 181/272, 275
See application file for complete search history.

(56) References Cited

U.S. PATENT DOCUMENTS 2,187,431 A * 1/1940 Powell ..... 29/890.08
3,771,315 A * 11/1973 Scott ..... 60/297

(Continued)

FOREIGN PATENT DOCUMENTS

DE 35 06 150 A1 8/1986
GB 2 352 480 A 1/2001

(Continued)

OTHER PUBLICATIONS

International Search Report for corresponding International Application No. PCT/IB2011/003054 mailed Apr. 18, 2012.

*Primary Examiner* — Jeremy Luks
(74) *Attorney, Agent, or Firm* — Sughrue Mion, PLLC

(57) ABSTRACT

A silencing apparatus for a vehicle includes: a muffler (1; 20; 30; 40) having a flattened sectional shape; an inlet pipe (7; 26; 36; 46); an outlet pipe (8; 27; 37; 47); and at least one partition plate (2, 3; 21, 22; 31, 32; 41, 42) that divides the inside of the muffler (1; 20; 30; 40) into a plurality of sound-deadening chambers. Each of the at least one partition plate (2, 3; 21, 22; 31, 32; 41, 42) has at least one communication hole. Within the muffler (1; 20; 30; 40), at least one among an opening of the inlet pipe (7; 26; 36; 46), an opening of the outlet pipe (8; 27; 37; 47), and the at least one communication hole is disposed at a position that is apart by a length equal to a half of the width of the muffler (1; 20; 30; 40) from one end of the muffler (1; 20; 30; 40) in the width direction thereof, and at least one among them is disposed at a position that is apart by a length equal to a quarter of the width from one end of the muffler (1; 20; 30; 40) in the width direction.

5 Claims, 9 Drawing Sheets

(56) References Cited

U.S. PATENT DOCUMENTS

| | | | | |
|---|---|---|---|---|
| 4,735,283 | A * | 4/1988 | Macaluso | 181/265 |
| 4,930,597 | A * | 6/1990 | Udell | 181/256 |
| 4,953,660 | A * | 9/1990 | Jewell et al. | 181/282 |
| 5,559,308 | A * | 9/1996 | Hayashi | 181/265 |
| 5,816,361 | A | 10/1998 | Gerber | |
| 5,959,263 | A * | 9/1999 | Foltz, Jr. | 181/254 |
| 6,173,808 | B1 * | 1/2001 | Maeda et al. | 181/254 |
| 6,341,664 | B1 * | 1/2002 | Gerber | 181/282 |
| 6,427,802 | B1 * | 8/2002 | Yokoi et al. | 181/282 |
| 7,063,182 | B2 * | 6/2006 | Proctor | 181/268 |
| 2005/0126850 | A1 | 6/2005 | Yamaguchi et al. | |
| 2006/0113145 | A1 * | 6/2006 | Toyoshima et al. | 181/268 |
| 2006/0266580 | A1 * | 11/2006 | Seiler | 181/268 |

FOREIGN PATENT DOCUMENTS

| | | | |
|---|---|---|---|
| JP | 3011359 | U | 3/1995 |
| JP | 2005-171933 | A | 6/2005 |
| JP | 2009-062922 | A | 3/2009 |
| WO | 2009/031012 | A2 | 3/2009 |

* cited by examiner

FIG. 10A
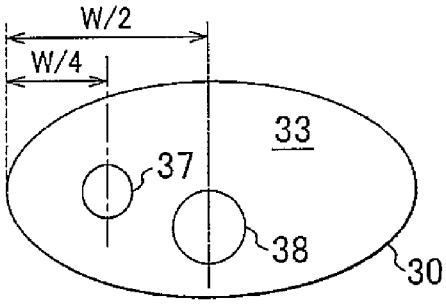
FIG. 10B
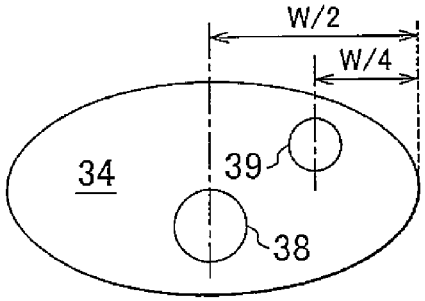
FIG. 10C
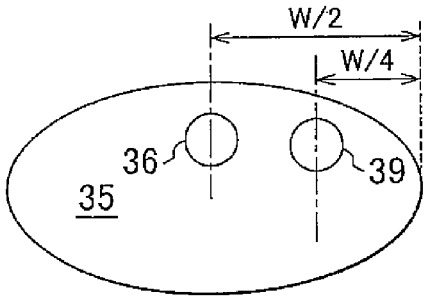
FIG. 11A
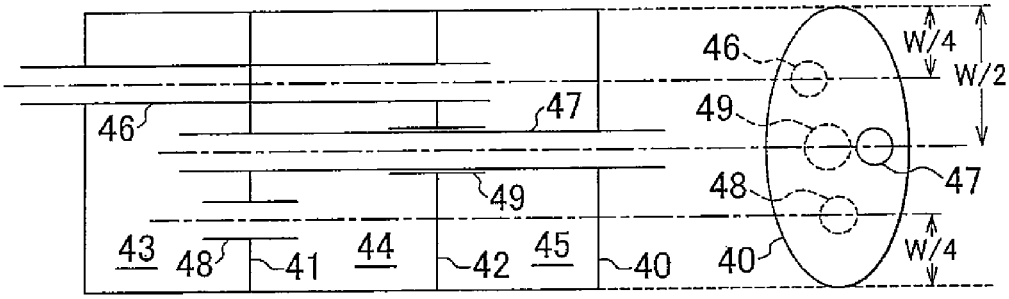
FIG. 11B

SILENCING APPARATUS FOR VEHICLE

BACKGROUND OF THE INVENTION

1. Field of the Invention

The invention relates to a silencing apparatus for a vehicle, which includes a muffler having a flattened sectional shape in which the width is greater than the height, an inlet pipe through which exhaust gas flows into an inside of the muffler, an outlet pipe through which the exhaust gas flows out of the inside of the muffler, a partition plate that divides the inside of the muffler into sound-deadening chambers, and a communication hole that extends through the partition plate.

2. Description of Related Art

As a silencing apparatus for a vehicle, there is a muffler provided in an exhaust system of an internal combustion engine. The muffler disposed beneath the floor of a vehicle generally has a flattened sectional shape in which the width is greater than the height, for example, an elliptical sectional shape, en elongated circular sectional shape, etc., for the sake of mountability.

A muffler having a flattened sectional shape that has a width W as shown in FIG. 13A will be considered. In this muffler, air column resonance occurs in the width direction thereof, with two opposite ends of the muffler in the width direction thereof being closed ends. The air column resonance lowers the sound deadening performance of the muffler. The wavelength λ of a standing wave that causes air column resonance in the muffler in the width direction thereof is "2W/n (n is an integer equal to or greater than 1)". If the sonic velocity is represented by "C (≈20×vT where T is the gas temperature within the muffler)", the frequency f of the air column resonance is represented as "C×m/2W (m is an integer equal to or greater than 1)". In this air column resonance, the standing waves that most conspicuously appear are two standing waves, that is, a standing wave whose wavelength λ is twice the muffler width (λ=2W) as shown in FIG. 13B, and a standing wave whose wavelength λ is equal to the muffler width (λ=W) as shown in FIG. 13C.

In related art, as a countermeasure against high-frequency exhaust sound as in the air column resonance in the width direction of a muffler, a sub-muffler that has a high-frequency resonance structure or that is filled with a sound absorbing material is provided in the exhaust system, as in Japanese Patent Application Publication No. 2009-062922 (JP-A-2009-062922).

If the sub-muffler is appropriately designed, it is certainly possible to restrain increase of the exhaust sound that results from the air column resonances in the width direction of the muffler. However, if the sub-muffler is installed, corresponding increases in cost and mass are inevitable. Therefore, it is demanded to provide a vehicle silencing apparatus that effectively restrains the increase of exhaust sound caused by the air column resonances in the muffler width direction at a reduced cost.

SUMMARY OF THE INVENTION

The invention provides a silencing apparatus for a vehicle, which effectively restrains the increase of exhaust sound caused by air column resonances in the width direction of a muffler.

PRINCIPLE OF INVENTION

Firstly, the principle of the invention will be explained. FIG. 1 shows the case where, in a sound-deadening chamber

51 formed within a muffler 50 with a flattened sectional shape having a width W, openings 52 and 53 leading to the outside of the sound-deadening chamber 51 are formed at a position that is apart by a length (W/2) equal to a half of the width W of the muffler 50 from one end of the muffler 50 in the width direction thereof (a right-side end in FIG. 1) and a position that is apart by a length (W/4) equal to a quarter of the width W from the same end in the width direction, respectively. In this muffler 50, there occurs air column resonance in the width direction caused by two standing waves, that is, a standing wave (λ=2W) whose wavelength λ is twice the width W of the muffler 50 and a standing wave (λ=W) whose wavelength λ is equal to the width W of the muffler 50.

When focus is placed on the opening 52 provided at the position that is apart from the end by the length of W/2, a space to the right of the opening 52 in FIG. 2A is a space that is open to the outside through the opening 53. On the other hand, a space to the left side of the opening 52, which is hatched in FIG. 2A, is a space that is not open to the outside, that is, a space that is closed to the outside. The closed space functions as an acoustic tube having a length of W/2. The acoustic tube achieves a sound absorbing effect, that is, the effect of reducing sound caused by the air column resonance with the wavelength λ of 2W (λ=2W) shown in FIG. 13B, by producing a standing wave that is opposite in phase due to resonance as shown in FIG. 2B.

When focus is placed on the opening 53 provided at the position that is apart from the end by the length of W/4, a space to the left side of the opening 53 is a space that is open to the outside through the opening 52 as shown in FIG. 3A. On the other hand, a space to the right side of the opening 53, which is hatched in FIG. 3A, is a space that is not open to the outside, that is, a space that is closed to the outside. This closed space functions as an acoustic tube having a length of W/4. The tube achieves a sound absorbing effect, that is, the effect of reducing sound caused by the air column resonance with the wavelength λ of W (λ=W) shown in FIG. 13C, by producing a standing wave that is opposite in phase due to resonance as shown in FIG. 3B.

Thus, the sound-deadening chamber 51 of the muffler 50 in which the openings 52 and 53 are formed at the above-described positions achieves the sound-absorbing effect, that is, the effect of reducing sound caused by the most conspicuous air column resonances among the air column resonances in the width direction of the muffler 50, that is, the air column resonances with the wavelength of λ=2W and the wavelength of λ=W. Therefore, by providing the muffler 50 in which openings (communication holes) leading to the outside are formed respectively at the position that is apart by the length equal to a half of the width W of the muffler 50 from one end of the muffler 50 in the width direction and the position that is apart by the length equal to a quarter of the width W from one end of the muffler 50 in the width direction, it is possible to effectively restrain the increase of exhaust sound caused by the air column resonances in the width direction of the muffler, without a need to provide a sub-muffler.

A first aspect of the invention relates to a silencing apparatus for a vehicle. This silencing apparatus includes: a muffler having a flattened sectional shape in which a width is greater than a height; an inlet pipe through which exhaust gas flows into an inside of the muffler; an outlet pipe through which the exhaust gas flows out of the inside of the muffler; and at least one partition plate that divides the inside of the muffler into a plurality of sound-deadening chambers. Each of the at least one partition plate has at least one communication hole that extends through the partition plate. Within the muffler, at least one among an opening of the inlet pipe, an opening of the outlet pipe, and the at least one communication hole is disposed at a position that is apart by a length equal to a half of the width of the muffler from one end of the muffler in a width direction of the muffler, and at least one among the opening of the inlet pipe, the opening of the outlet pipe, and the at least one communication hole is disposed at a position that is apart by a length equal to a quarter of the width of the muffler from one end of the muffler in the width direction.

As described above, within the muffler, the opening or the communication hole, which leads to the outside of the sound-deadening chamber, is disposed at each of the position that is apart by the length equal to a half of the width W of the muffler from one end of the muffler in the width direction of the muffler and the position that is apart by the length equal to a quarter or the width W from one end in the width direction. This muffler achieves a sound absorbing effect, that is, the effect of reducing sound caused by the air column resonances with a wavelength λ of 2W (λ=2W) and a wavelength λ of W (λ=W), which most conspicuously appear among the air column resonances in the width direction of the muffler. Therefore, according to the foregoing configuration, it is possible to effectively restrain the increase of exhaust sound caused by the air column resonances in the width direction of the muffler, without a need to provide a sub-muffler.

In order to more reliably achieve the effect of reducing the exhaust sound, each of the opening of the inlet pipe, the opening of the outlet pipe, and the at least one communication hole may be disposed at either the position that is apart by the length equal to a half of the width of the muffler from one end of the muffler in the width direction, or the position that is apart by the length equal to a quarter of the width of the muffler from one end of the muffler in the width direction.

In each of the sound-deadening chambers, each of the position that is apart by the length equal to a half of the width of the muffler from one end of the muffler in the width direction of the muffler and the position that is apart by the length equal to a quarter of the width of the muffler from the same end in the width direction may be a position at which the opening of the inlet pipe, the opening of the outlet pipe, or one of the at least one communication hole is disposed. In this case, in all the sound-deadening chambers, the sound absorbing effect, that is, the effect of reducing sound caused by the air column resonances with the wavelength λ of 2W (λ=2W) and the wavelength λ of W (λ=W) is achieved, so that the increase of exhaust sound caused by the air column resonances can be more reliably restrained.

A second aspect of the invention relates to a silencing apparatus for a vehicle. This silencing apparatus includes: a muffler having a flattened sectional shape in which a width is greater than a height; an inlet pipe through which exhaust gas flows into an inside of the muffler; an outlet pipe through which the exhaust gas flows out of the inside of the muffler; and at least one partition plate that divides the inside of the muffler into a plurality of sound-deadening chambers. Each of the at least one partition plate has at least one communication hole that extends through the partition plate. An opening of the inlet pipe, an opening of the outlet pipe, and the at least one communication hole are disposed within the muffler. In each of the sound-deadening chambers, at least one among the opening of the inlet pipe, the opening of the outlet pipe, and the at least one communication hole is disposed at a position that is apart by a length equal to a half of the width of the muffler from one end of the muffler in a width direction of the muffler, and at least one among the opening of the inlet pipe, the opening of the outlet pipe, and the at least one communication hole is disposed at a position that is apart by a length equal to a quarter of the width from the same end in the width direction.

In the muffler in which the opening of the inlet pipe, the opening of the outlet pipe, and the at least one communication hole are disposed as described above, the sound absorbing effect, that is, the effect of reducing sound caused by the air column resonances with the wavelength λ of 2W (λ=2W) and the wavelength λ of W (λ=W) is achieved in all the sound-deadening chambers, so that the increase of exhaust sound caused by the air column resonances can be more reliably restrained.

In a fore-aft direction of the muffler, the inside of the muffler may be divided by the at least one partition plate into the sound-deadening chambers each of which has a length in the fore-aft direction of the muffler, which is greater than or equal to a quarter of the width of the muffler. In this muffler, the air column resonance in the width direction of the muffler appears particularly conspicuously. Hence, the foregoing aspects of the invention are particularly suitably applied to a vehicle silencing apparatus that includes the muffler.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIGS. 10A to 10C are diagrams showing, arrangements of openings and communication holes in sound-deadening chambers of the muffler;

FIG. 11A is a sectional view schematically showing a sectional plan structure of a muffler in a silencing apparatus for a vehicle in accordance with a fourth embodiment of the invention, and FIG. 11B is a back elevation view schematically showing a back structure of the muffler in the silencing apparatus for a vehicle in accordance with the fourth embodiment of the invention;

DETAILED DESCRIPTION OF EMBODIMENTS

First Embodiment

Hereinafter, a silencing apparatus for a vehicle in accordance with a first embodiment of the invention will be described with reference to FIG. 4A to FIG. 6.

Figure 4A:
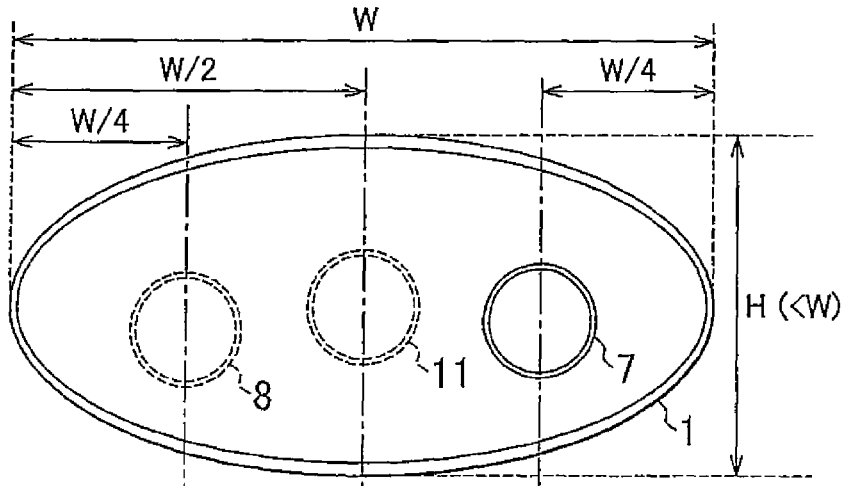
FIG. 4A is an elevation view showing an elevation structure of the muffler in a silencing apparatus for a vehicle in accordance with a first embodiment of the invention.
Figure 4B:
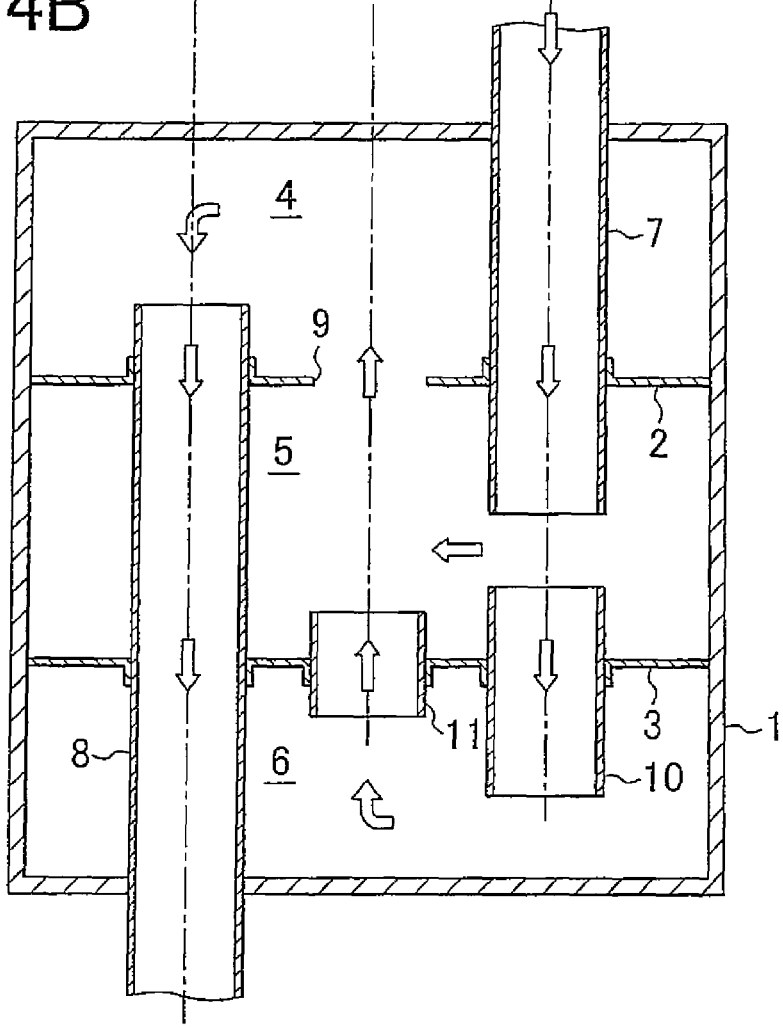
FIG. 4B is a sectional view showing a sectional plan structure of the muffler in the silencing apparatus for a vehicle in accordance with the first embodiment of the invention.

As shown in FIG. 4A, a muffler 1 has a flattened sectional shape (elliptical sectional shape) in which the width W is greater than the height H. As shown in FIG. 4B, an inside of the muffler 1 is divided, in the fore-aft direction thereof, into three sound-deadening chambers, that is, a first sound-deadening chamber 4, a second sound-deadening chamber 5, and a third sound-deadening chamber 6, by a first partition plate 2 and a second partition plate 3. The sound-deadening chambers 4 to 6 are formed so that the length of each of the sound-deadening chambers 4 to 6 in the fore-aft direction of the muffler 1 is greater than or equal to a quarter of the width W of the muffler 1. Arrows in FIG. 4B show flows of exhaust gas. In each embodiment, the first sound-deadening chamber, the second sound-deadening chamber, and the third sound-deadening, chamber are disposed in, the stated order in the fore-aft direction of the muffler.

An inlet pipe 7, through which exhaust gas flows into the inside of the muffler 1, is disposed at a position that is apart by a length (W/4) equal to a quarter of the width W of the muffler 1 from a right-side end (in FIG. 4B) of the muffler 1 in the width direction of the muffler 1 (the left-right direction in FIG. 4B). A distal end of the inlet pipe 7 has an opening in the second sound-deadening chamber 5. On the other hand, an outlet pipe 8, through which exhaust gas flows out of the inside of the muffler 1, is disposed at a position that is apart by the length (W/4) equal to a quarter of the width W of the muffler 1 from a left-side end (in FIG. 4B) of the muffler 1 in the width direction. A distal end of the outlet pipe 8 has an opening in the first sound-deadening chamber 4.

In the first partition plate 2, a communication hole 9 that extends through the first partition plate 2 is formed at a center of the muffler 1 in the width direction, that is, a position that is apart by a length (W/2) equal to a half of the width W of the muffler 1 from the two opposite ends thereof in the width direction. Through the communication hole 9, the first sound-deadening chamber 4 and the second sound-deadening chamber 5 communicate with each other. The second partition plate 3 is provided with communication pipes 10 and 11 that extend through the second partition plate 3, at a position that is apart by the length (W/4) equal to a quarter of the width W of the muffler 1 from the right-side end (in FIG. 4B) of the muffler 1 in the width direction and at a position that is apart by the length (W/2) equal to a half of the width W of the muffler 1 from the right-side end (in FIG. 4B) of the muffler 1 in the width direction, respectively. The first and second communication pipes 10 and 11 form communication holes that extend through the second partition plate 3.

Figure 5A:
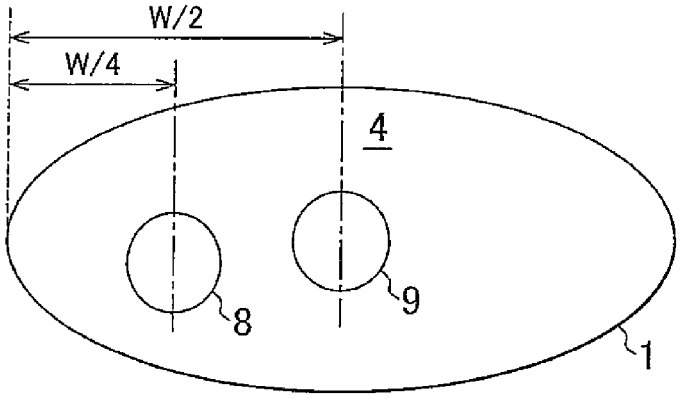
FIGS. 5A to 5C are diagrams showing arrangements of openings and communication holes in sound-deadening chambers of the muffler.

As shown in FIG. 5A, the first sound-deadening chamber 4 of the muffler 1 is open to the outside of the first sound-deadening chamber 4 through the opening of the distal end of the outlet pipe 8, at the position that is apart by the length equal to a quarter of the width W of the muffler 1 from the left-side end (in FIG. 5A) of the muffler 1 in the width direction. The first sound-deadening chamber 4 is open to the outside of the first sound-deadening chamber 4 through the communication hole 9 at the position that is apart by the length equal to a half of the width W of the muffler 1 from the left-side end (in FIG. 5A) of the muffler 1 in the width direction.

Figure 5B:
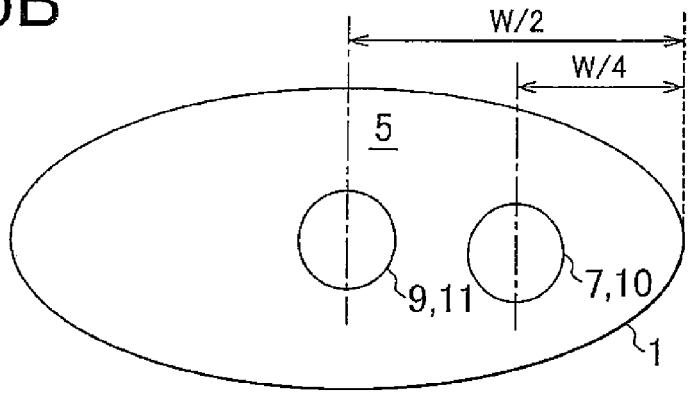

On the other hand, as shown in FIG. 5B, the second sound-deadening chamber 5 of the muffler 1 is open to the outside of the second second-deadening chamber 5 through the opening of the distal end of the inlet pipe 7 and through the first communication pipe 10, at the position that is apart by the length equal to a quarter of the width W of the muffler 1 from the right-side end (in FIG. 5B) of the muffler 1 in the width direction. The second sound-deadening chamber 5 is also open to the outside of the second sound-deadening chamber 5 through the communication hole 9 and the second communication pipe 11, at the position that is apart by the length equal to a half of the width W of the muffler 1 from the right-side end (in FIG. 5B) of the muffler 1 in the width direction.

Figure 5C:
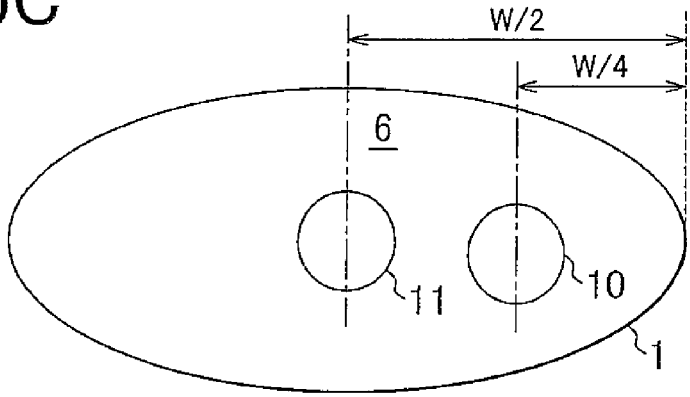

As shown in FIG. 5C, the third sound-deadening chamber 6 of the muffler 1 is open to the outside of the third sound-deadening chamber 6 through the first communication pipe 10 at the position that is apart by the length equal to a quarter of the width W of the muffler 1 from the right-side end (FIG. 5C) of the muffler 1 in the width direction. The third sound-deadening chamber 6 is open to the outside of the third sound-deadening chamber 6 through an opening of the second communication pipe 11 at the position that is apart by the length equal to a half of the width W of the muffler 1 from the right-side end (FIG. 5C) of the muffler 1 in the width direction.

As described above, in this muffler 1, each of the opening of the inlet pipe 7, the opening of the outlet pipe 8, the first communication pipe 10, the second communication pipe 11, and the communication hole 9 is disposed at either the position that is apart by the length equal to a half of the width W of the muffler 1 from one end of the muffler 1 in the width direction or the position that is apart by the length equal to a quarter of the width W from one end of the muffler 1 in the width direction. In other words, in each of the first to third sound-deadening chambers 4 to 6, at least one among the opening of the inlet pipe 7, the opening of the outlet pipe 8, the communication hole formed by the first communication pipe 10, the communication hole formed by the second communication pipe 11, and the communication hole 9 is disposed at the position that is apart by the length equal to a half of the width W of the muffler 1 from one end of the muffler 1 in the width direction, and at least one among the opening of the inlet pipe 7, the opening of the outlet pipe 8, the communication hole formed by the first communication pipe 10, the communication hole formed by the second communication pipe 11, and the communication hole 9 is disposed at the position that is apart by the length equal to a quarter of the width W of the muffler 1 from the same end of the muffler 1 in the width direction.

As described above, a sound-deadening effect, that is, the effect of reducing sound caused by the air column resonances can be achieved in a sound-deadening chamber in which openings leading to the outside of the sound-deadening chamber are formed respectively at the position that is apart by the length equal to a half of the width W of the muffler 1 from one end of the muffler 1 in the width direction and the position that is apart by the length equal to a quarter of the width W of the muffler 1 from the same end of the muffler 1 in the width direction. Therefore, in the muffler 1 in which the openings are disposed as described above, the sound-deadening effect, that is, the effect of reducing sound caused by the air column resonances can be achieved in each sound-deadening chamber.

Figure 6:
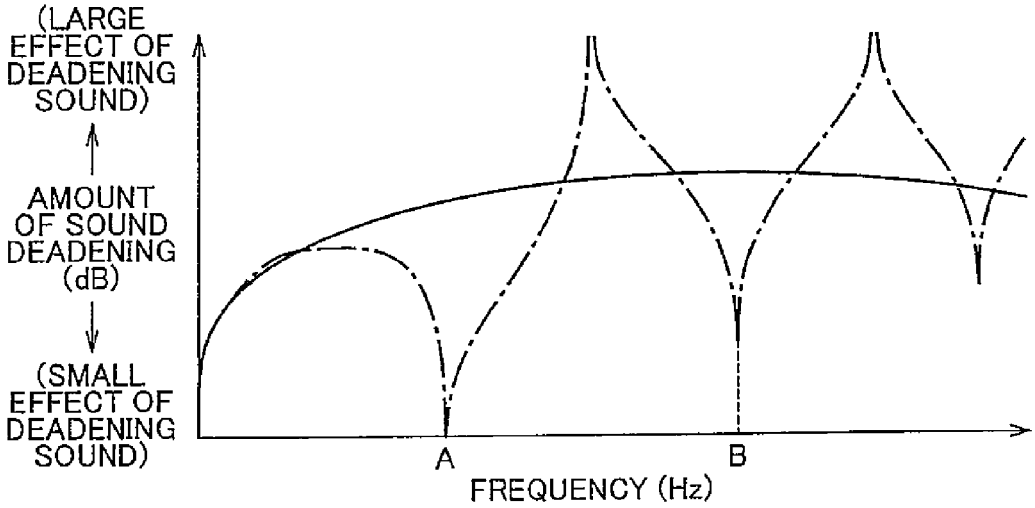
FIG. 6 is a graph showing the amounts of sound deadening at wavelengths with regard to the muffler in accordance with the first embodiment, in comparison with the case where the positions of openings and communication holes are not optimized.

The following mathematical expression (1) represents a sound deadening characteristic of a sound-deadening chamber that has two openings. The left side of the expression (1) represents the sound deadening characteristic of the muffler 1, and the first term on the right side represents the sound deadening performance of the sound-deadening chamber as a closed space. The second term on the right side represents the sound deadening performance of an acoustic tube that is formed by a closed space extending from one opening to the other opening. Each of the third and fourth terms on the right side represents the sound deadening characteristic of an acoustic tube that is formed by a closed space extending from one opening to a closed end.

$$20\log|Z_3Y_f| = 20\log m_{23} + 20\log|\sin kW| - 20\log|\cos kW_a| - 20\log|kW_b| \quad (1)$$

where $S_2$ is the sectional area of the muffler, $S_3$ is the sectional area of the opening, $m_{23}$ is an expansion ratio ($=S_2/S_3$), m is an integer equal to or greater than 1, C is $20\times\sqrt{T}$, T is the gas temperature, W is the width of the muffler, each of $W_a$ and $W_b$ is the length from one end of the muffler in the width direction to one opening, k is a wavelength constant ($=2\pi f/c$), $Z_3$ is the characteristic impedance of an acoustic tube, and $Y_f$ is the equivalent open transfer admittance of a cavity portion. FIG. 6 shows a relation between the frequency and the amount of sound deadening in the muffler 1 derived from the foregoing expression (1). In the case where $W_a$ and $W_b$ in the foregoing expression (1) are not appropriately adjusted, the amount of sound deadening considerably declines at the frequencies A and B as shown by a one-dot chain line in FIG. 6. The frequencies A and B are frequencies of the air column resonance whose wavelength is twice the width W of the muffler 1, and of the air column resonance whose wavelength is equal to the width W.

On the other hand, in the case where $W_a$ is set at a half of the width W of the muffler 1 and $W_b$ is set at a quarter of the width W of the muffler 1, there is no region where the amount of sound deadening greatly declines, as shown in a thick solid line. This is because the frequency of the air column resonance coincides with the frequency at which the sound deadening effect of the acoustic tube formed by the closed space is achieved. The resonance frequencies when the inside of the muffler 1 is a space whose two ends are closed are represented by the following expression (2), and the resonance frequency when the inside of the muffler 1 is a space in which only one of the two ends is closed is represented by each of the following expressions (3) and (4). As is apparent from these expressions, if $W_a$ is set at W/2 ($W_a$=W/2) and $W_b$ is set at W/4 ($W_b$=W/4), the resonance frequencies when both ends are closed coincide with the resonance frequencies when one end is closed, so that the standing waves due to the air column resonance are reduced.

$$f = \frac{C}{2W} \times m \quad (2)$$

($m$ is an integer equal to or greater than 1)

$$f = \frac{C}{4Wa} \quad (3)$$

(in the case where $m$ is 1($m$ = 1))

$$f = \frac{C}{4Wb} \quad (4)$$

(in the case where $m$ is 2($m$ = 2))

According to the silencing apparatus for a vehicle of the foregoing embodiment, the following effects can be achieved.

(1) In this embodiment, within the muffler 1, at least one among the opening of the inlet pipe 7, the opening of the outlet pipe 8, the communication hole 9, and the communication holes formed in the second partition plate 3 by the first and second communication pipes 10 and 11 is disposed at the position that is apart by the length equal to a half of the width W of the muffler 1 from one end of the muffler 1 in the width direction. At least one among the opening of the opening of the inlet pipe 7, the opening of the outlet pipe 8, the communication hole 9, and the communication holes formed in the second partition plate 3 is disposed at the position that is apart by the length equal to a quarter of the width W from one end of the muffler 1 in the width direction. Therefore, according to the foregoing configuration, it is possible to effectively restrain the increase of exhaust sound that is caused by the air column resonances in the width direction of the muffler, without a need to provide a sub-muffler.

(2) In this embodiment, each of the opening of the inlet pipe 7, the opening of the outlet pipe 8, the communication hole 9, and the communication holes formed in the second partition plate 3 by the first and second communication pipes 10 and 11 is disposed at either the position that is apart by the length equal to a half of the width W of the muffler 1 from one end of the muffler 1 in the width direction or the position that is apart by the length equal a quarter of the width W of the muffler 1 from one end of the muffler 1 in the width direction. Therefore, the effect of reducing exhaust sound can be more reliably obtained.

(3) In the foregoing embodiment, in each of the first to third sound-deadening chambers 4 to 6, each of the position that is apart by the length equal to a half of the width W of the muffler 1 from one end of the muffler 1 in the width direction and the position that is apart by the length equal to a quarter of the width W of the muffler 1 from the same end in the width direction is the position at which the opening of the inlet pipe, the opening of the outlet pipe, or the communication hole is disposed. That is, in the embodiment, in each of the first to third sound-deadening chambers 4 to 6, at least one among the opening of the inlet pipe, the opening of the outlet pipe, and the plurality of communication holes is disposed at the position that is apart by the length equal to a half of the width W of the muffler 1 from one end of the muffler in the width direction, and at least one among the opening of the inlet pipe, the opening of the outlet pipe, and the plurality of communication holes is disposed at the position that is apart by the length equal to a quarter of the width W from the same end in the width direction. In the muffler in which the openings and the communication holes are disposed as described above, the sound absorbing effect, that is, the effect of reducing sound caused by the air column resonances with a wavelength λ of 2W (λ=2W) and a wavelength λ of W (λ=W) is achieved in all the sound-deadening chambers, so that the increase of exhaust sound caused by the air column resonances can be more reliably restrained.

Second Embodiment

Next, a silencing apparatus for a vehicle in accordance with a second embodiment of the invention will be described in detail below with reference to FIGS. 7A and 7B and FIGS. 8A to 8C.

Figures 7A, 7B:
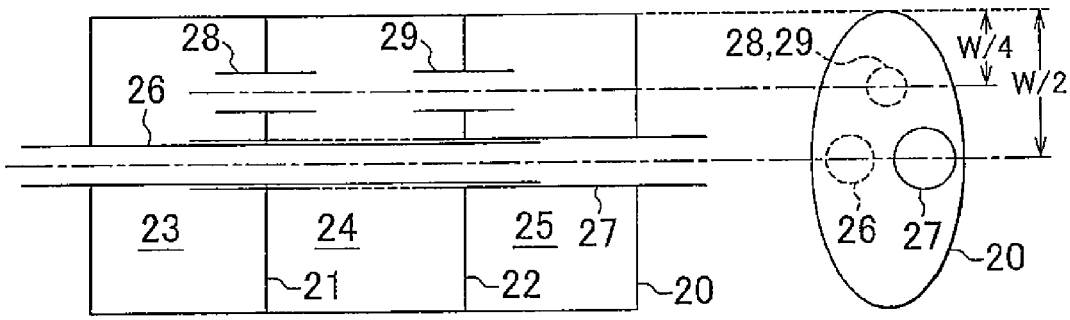
FIG. 7A is a sectional view schematically showing a sectional plan structure of a muffler in a silencing apparatus for a vehicle in accordance with a second embodiment of the invention.
FIG. 7B is a back elevation view schematically showing a back structure of the muffler in the silencing apparatus for a vehicle in accordance with the second embodiment of the invention.

As shown in FIGS. 7A and 7B, an inside of a muffler 20 with a flattened sectional shape is divided by a first partition plate 21 and a second partition plate 22 into three spaces, that is, a first sound-deadening chamber 23, a second sound-deadening chamber 24 and a third sound-deadening chamber 25. The sound-deadening chambers 23 to 25 are formed so that the length of each of the sound-deadening chambers 23 to 25 in the fore-aft direction of the muffler 20 is greater than or equal to a quarter of the width W of the muffler 20.

An inlet pipe 26, through which exhaust gas flows into the inside of the muffler 20, is disposed at a position that is apart by a length (W/2) equal to a half of a width W of the muffler 20 from an upper-side end (in FIGS. 7A and 7B) of the muffler 20 in the width direction of the muffler 20 (the up-down direction in FIGS. 7A and 7B). A distal end of the inlet pipe 26 has an opening in the third sound-deadening chamber 25. On the other hand, an outlet pipe 27, through which exhaust gas flows out of the inside of the muffler 20, is disposed at a position that is apart by the length (W/2) equal to a half of the width W of the muffler 20 from the upper-side end (in FIGS. 7A and 7B) of the muffler 20 in the width direction. A distal end of the outlet pipe 27 has an opening in the first sound-deadening chamber 23. In the second sound-deadening chamber 24, a side peripheral wall of the outlet pipe 27 is provided with a plurality of small holes. The outlet pipe 27 is open to the second sound-deadening chamber 24 through the small holes.

The first partition plate 21 is provided with a first communication pipe 28 that extends through the first partition plate 21, at a position that is apart by a length (W/4) equal to a quarter of the width W of the muffler 20 from the upper-side end (in FIGS. 7A and 7B) of the muffler 20 in the width direction. A second communication pipe 29 that extends through the second partition plate 22 is disposed at the position that is apart by the length (W/4) equal to a quarter of the width W of the muffler 20 from the upper-side end (in FIGS. 7A and 7B) of the muffler 20 in the width direction. The first and second communication pipes 28 and 29 form a communication hole that extends through the first partition plate 21 and a communication hole that extends through the second partition plate 22, respectively.

Figure 8A:
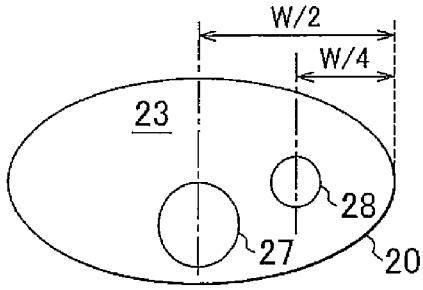
FIGS. 8A to 8C are diagrams showing arrangements of openings and communication holes in sound-deadening chambers of the muffler.

As shown in FIG. 8A, the first sound-deadening chamber 23 of the muffler 20 is open to the outside of the first sound-deadening chamber 23 through the first communication pipe 28 at the position that is apart by the length equal to a quarter of the width W of the muffler 20 from a right-side end (FIG. 8A) of the muffler 20 in the width direction. The first sound-deadening chamber 23 is open to the outside of the first sound-deadening chamber 23 through the opening of the distal end of the outlet pipe 27 at the position that is apart by the length equal to a half of the width W of the muffler 20 from the right-side end (FIG. 8A) of the muffler 20 in the width direction.

Figure 8B:
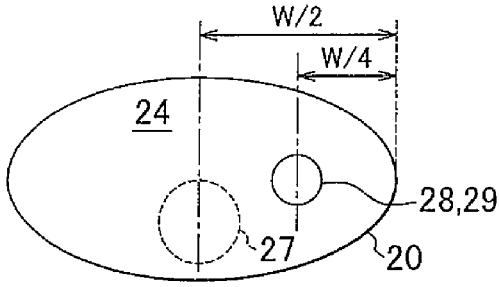

As shown in FIG. 8B, the second sound-deadening chamber 24 of the muffler 20 is open to the outside of the second sound-deadening chamber 24 through the first communication pipe 28 and the second communication pipe 29, at the position that is apart by the length equal to a quarter of the width W of the muffler 20 from the right-side end (FIG. 8B) of the muffler 20 in the width direction. The second sound-deadening chamber 24 is open to the outside of the second sound-deadening chamber 24 through the small holes (openings) formed on the side peripheral wall of the outlet pipe 27, at the position that is apart by the length equal to a half of the width W of the muffler 20 from the right-side end (FIG. 8B) of the muffler 20 in the width direction.

Figure 8C:
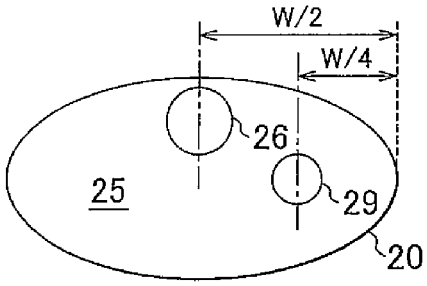

Furthermore, as shown in FIG. 8C, the third sound-deadening chamber 25 of the muffler 20 is open to the outside of the third sound-deadening chamber 25 through the second communication pipe 29, at the position that is apart by the length equal to a quarter of the width W of the muffler 20 from the right-side end (FIG. 8C) of the muffler 20 in the width direction. The third sound-deadening chamber 25 is open to the outside of the third sound-deadening chamber 25 through the opening of the distal end of the inlet pipe 26, at the position that is apart by the length equal to a half of the width W of the muffler 20 from the right-side end (FIG. 8C) of the muffler 20 in the width direction.

As described above, in this muffler 20, each of the opening of the inlet pipe 26, the opening of the outlet pipe 27, the first communication pipe 28, and the second communication pipe 29 is disposed at either the position that is apart by the length equal to a half of the width W of the muffler 20 from one end of the muffler 20 in the width direction or the position that is apart by the length equal to a quarter of the width W from one end of the muffler 20 in the width direction. In other words, in each of the first to third sound-deadening chambers 23 to 25, at least one among the opening of the inlet pipe 26, the opening of the outlet pipe 27, the communication hole formed by the first communication pipe 28, and the communication hole formed by the second communication pipe 29 is disposed at the position that is apart by the length equal to a half of the width W of the muffler 20 from one end of the muffler 20 in the width direction, and at least one among the opening of the inlet pipe 26, the opening of the outlet pipe 27, the communication hole formed by the first communication pipe 28, and the communication hole formed by the second communication pipe 29 is disposed at the position that is apart by the length equal to a quarter of the width W of the muffler 20 from the same end of the muffler 20 in the width direction. Therefore, in this embodiment, too, the effects described above as (1) to (3) can be achieved.

Third Embodiment

Next, a silencing apparatus for a vehicle in accordance with a third embodiment of the invention will be described in detail below with reference to FIGS. 9A and 9B and FIGS. 10A to 10C.

Figures 9A, 9B:
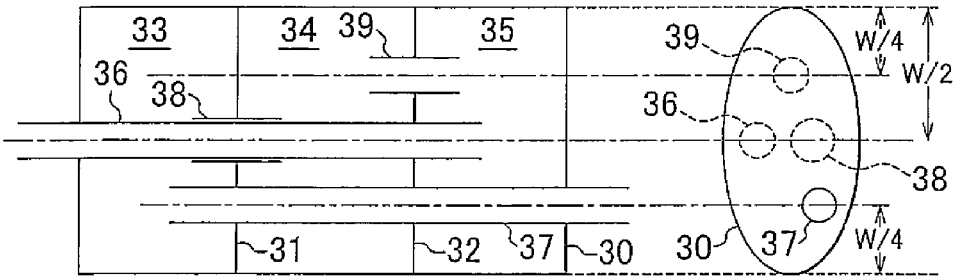
FIG. 9A is a sectional view schematically showing a sectional plan structure of a muffler in a silencing apparatus for a vehicle in accordance with a third embodiment of the invention.
FIG. 9B is a back elevation view schematically showing a back structure of the muffler in the silencing apparatus for a vehicle in accordance with the third embodiment of the invention.

As shown in FIGS. 9A and 9B, an inside of a muffler 30 with a flattened sectional shape is divided by a first partition plate 31 and a second partition plate 32 into three spaces, that is, a first sound-deadening chamber 33, a second sound-deadening chamber 34 and a third sound-deadening chamber 35. The sound-deadening chambers 33 to 35 are formed so that the length of each of the sound-deadening chambers 33 to 35 in the fore-aft direction of the muffler 30 is greater than or equal to a quarter of a width W of the muffler 30.

An inlet pipe 36, through which exhaust gas flows into the inside of the muffler 30, is disposed at a position that is apart by a length (W/2) equal to a half of the width W of the muffler 30 from an upper-side end (in FIGS. 9A and 9B) of the muffler 30 in the width direction of the muffler 30 (the up-down direction in FIGS. 9A and 9B). A distal end of the inlet pipe 36 has an opening in the third sound-deadening chamber 35. On the other hand, an outlet pipe 37, through which exhaust gas flows out of the inside of the muffler 30, is disposed at a position that is apart by a length (W/4) equal to a quarter of the width W of the muffler 30 from a lower-side end (in FIGS. 9A and 9B) of the muffler 30 in the width direction. A distal end of the outlet pipe 37 has an opening in the first sound-deadening chamber 33.

The first partition plate 31 is provided with a first communication pipe 38 that extends through the first partition plate 31, at the position that is apart by the length (W/2) equal to a half of the width W of the muffler 30 from the upper-side end (FIGS. 9A and 9B) of the muffler 30 in the width direction. The second partition plate 32 is provided with a second communication pipe 39 that extends through the second partition plate 32, at the position that is apart by the length (W/4) equal to a quarter of the width W of the muffler 30 from the upper-side end (in FIGS. 9A and 9B) of the muffler 30 in the width direction. The first and second communication pipes 38 and 39 form a communication hole that extends through the first partition plate 31 and a communication hole that extends through the second partition plate 32, respectively.

As shown in FIG. 10A, the first sound-deadening chamber 33 of the muffler 30 is open to the outside of the first sound-deadening chamber 33 through the opening of the distal end of the outlet pipe 37, at the position that is apart by the length equal to a quarter of the width W of the muffler 30 from a left-side end (FIG. 10A) of the muffler 30 in the width direction. The first sound-deadening chamber 33 is open to the outside of the first sound-deadening chamber 33 through the first communication pipe 38, at the position that is apart by the length equal to a half of the width W of the muffler 30 from the left-side end (FIG. 10A) of the muffler 30 in the width direction.

As shown in FIG. 10B, the second sound-deadening chamber 34 of the muffler 30 is open to the outside of the second sound-deadening chamber 34 through the second communication pipe 39, at the position that is apart by the length equal to a quarter of the width W of the muffler 30 from a right-side end (FIG. 10B) of the muffler in the width direction. The second sound-deadening chamber 34 is open to the outside of the second sound-deadening chamber 34 through the first communication pipe 38, at the position that is apart by the length equal to a half of the width W of the muffler 30 from the right-side end (FIG. 10B) of the muffler 30 in the width direction.

Furthermore, as shown in FIG. 10C, the third sound-deadening chamber of the muffler 30 is open to the outside of the third sound-deadening chamber 35 through the second communication pipe 39, at the position that is apart by the length equal to a quarter of the width W of the muffler 30 from the right-side end (FIG. 10C) of the muffler 30 in the width direction. The third sound-deadening chamber 35 is open to the outside of the third sound-deadening chamber 35 through the opening of the distal end of the inlet pipe 36, at the position that is apart by the length equal to a half of the width W of the muffler 30 from the right-side end (FIG. 10C) of the muffler 30 in the width direction.

As described above, in this muffler 30, each of the opening of the inlet pipe 36, the opening of the outlet pipe 37, the first communication pipe 38, and the second communication pipe 39 is disposed at either the position that is apart by the length equal to a half of the width W of the muffler 30 from one end of the muffler 30 in the width direction or the position that is apart by the length equal to a quarter of the width W from one end of the muffler 30 in the width direction. In other words, in each of the first to third sound-deadening chambers 33 to 35, at least one among the opening of the inlet pipe 36, the opening of the outlet pipe 37, the communication hole formed by the first communication pipe 38, and the communication hole formed by the second communication pipe 39 is disposed at the position that is apart by the length equal to a half of the width W of the muffler 30 from one end of the muffler 30 in the width direction, and at least one among the opening of the inlet pipe 36, the opening of the outlet pipe 37, the communication hole formed by the first communication pipe 38, and the communication hole formed by the second communication pipe 39 is disposed at the position that is apart by the length equal to a quarter of the width W of the muffler 30 from the same end of the muffler 30 in the width direction. Therefore, in this embodiment, too, the effects described above as (1) to (3) can be achieved.

Fourth Embodiment

Next, a silencing apparatus for a vehicle in accordance with a fourth embodiment of the invention will be described in detail below with reference to FIGS. 11A and 11B and FIGS. 12A to 12C.

As shown in FIGS. 11A and 11B, an inside of a muffler 40 with a flattened sectional shape is divided by a first partition plate 41 and a second partition plate 42 into three spaces, that is, a first sound-deadening chamber 43, a second sound-deadening chamber 44, and a third sound-deadening chamber 45. The sound-deadening chambers 43 to 45 are formed so that the length of each of the sound-deadening chambers 43 to 45 in the fore-aft direction of the muffler 40 is greater than or equal to a quarter of a width W of the muffler 40.

Figure 1:
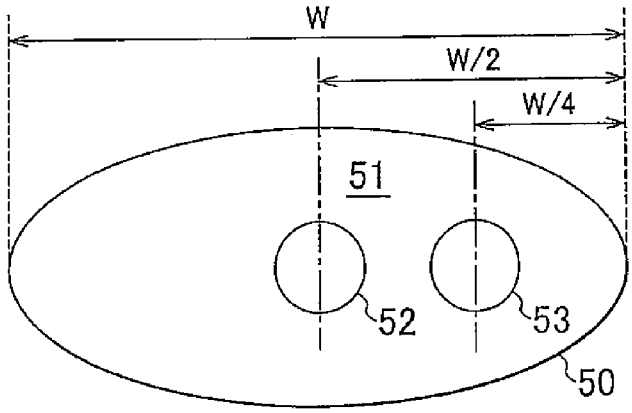
FIG. 1 is a sectional view schematically showing a sectional elevation view of a muffler presented as a model for explaining the principle or the invention.
Figure 2A:
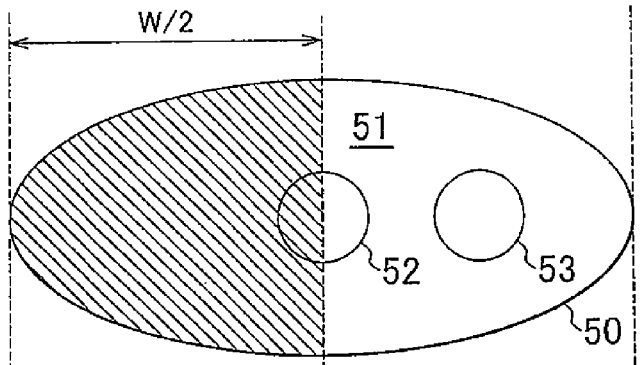
FIG. 2A is a sectional view showing a manner of forming a closed space, that functions as an acoustic tube, when focus is placed on an opening that is formed at a position that is apart by a length equal to a half of the width from an end of the muffler in a width direction thereof.
Figure 2B:
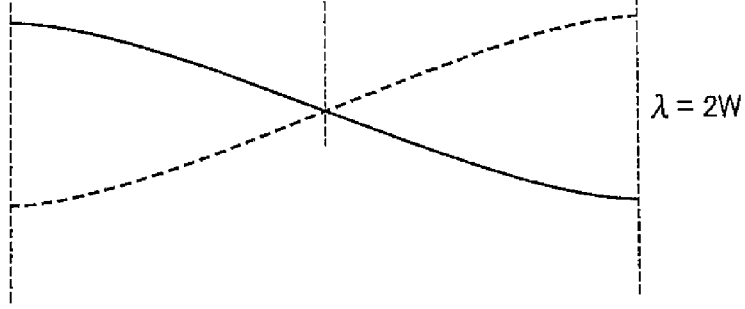
FIG. 2B is a graph showing a waveform of a standing wave that is produced in the closed space.
Figure 3A:
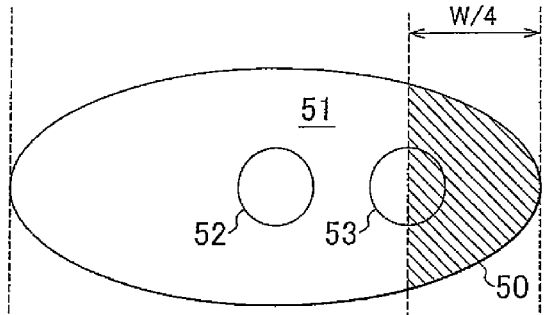
FIG. 3A is a sectional view showing a manner of forming a closed space that functions as an acoustic tube, when focus is placed on an opening that is formed at a position that is apart by a length equal to a quarter of the width from an end of the muffler in the width direction thereof.
Figure 3B:
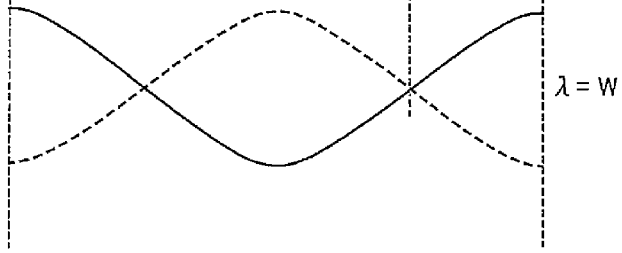
FIG. 3B is a graph showing a waveform of a standing wave that is produced in the closed space.

An inlet pipe 46, through which exhaust gas flows into the inside of the muffler 40, is disposed at a position that is apart by a length (W/4) equal to a quarter of the width W of the muffler 40 from an upper-side end (in FIGS. 11A and 1B) of the muffler 40 in the width direction of the muffler 40 (the up-down direction in FIGS. 11A and 11B). A distal end of the inlet pipe 46 has an opening in the third sound-deadening chamber 45. On the other hand, an outlet pipe 47, through which exhaust gas flows out of the inside of the muffler 40, is disposed at a position that is apart by a length (W/2) equal to a half of the width W of the muffler 40 from the upper-side end (in FIGS. 11A and 11B) of the muffler 40 in the width direction. A distal end of the outlet pipe 47 has an opening in the first sound-deadening chamber 43.

The first partition plate 41 is provided with a first communication pipe 48 that extends through the first partition plate 41, at a position that is apart by the length (W/4) equal to a quarter of the width W of the muffler 40 from a lower-side end (FIGS. 11A and 11B) of the muffler 40 in the width direction. A second communication pipe 49 that extends through the second partition plate 42 is disposed at the position that is apart by the length (W/2) equal to a half of the width W of the muffler 40 from the upper-side end (FIGS. 11A and 11B) of the muffler 40 in the width direction. The first and second communication pipes 48 and 49 form a communication hole that extends through the first partition plate 41 and a communication hole that extends through the second partition plate 42, respectively.

Figure 12A:
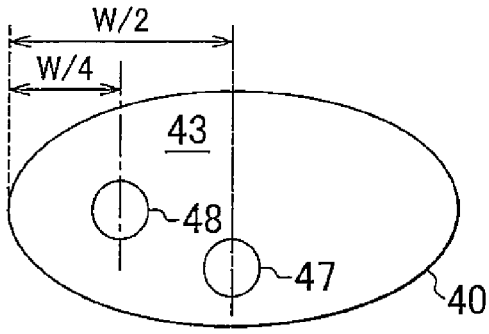
FIGS. 12A to 12C are diagrams showing arrangements of openings and communication holes in sound-deadening chambers of the muffler.

As shown in FIG. 12A, the first sound-deadening chamber 43 of the muffler 40 is open to the outside of the first sound-deadening chamber 43 through the first communication hole 48, at the position that is apart by the length equal to a quarter of the width W of the muffler 40 from a left-side end (FIG. 12A) of the muffler 40 in the width direction. The first sound-deadening chamber 43 is open to the outside of the first sound-deadening chamber 43 through the opening of the distal end of the outlet pipe 47, at the position that is apart by the length equal to a half of the width W of the muffler 40 from the left-side end (FIG. 12A) of the muffler 40 in the width direction.

Figure 12B:
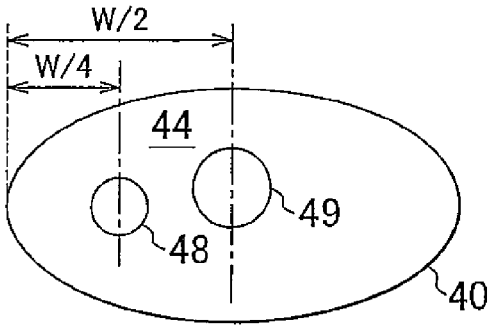
Figure 12C:
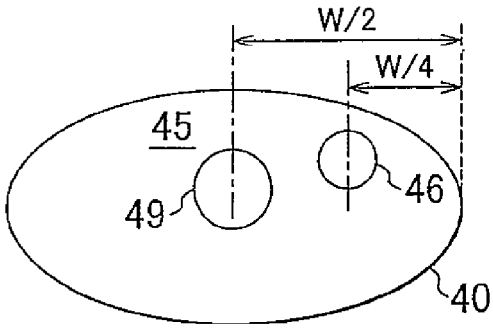
Figures 13A, 13B, 13C:
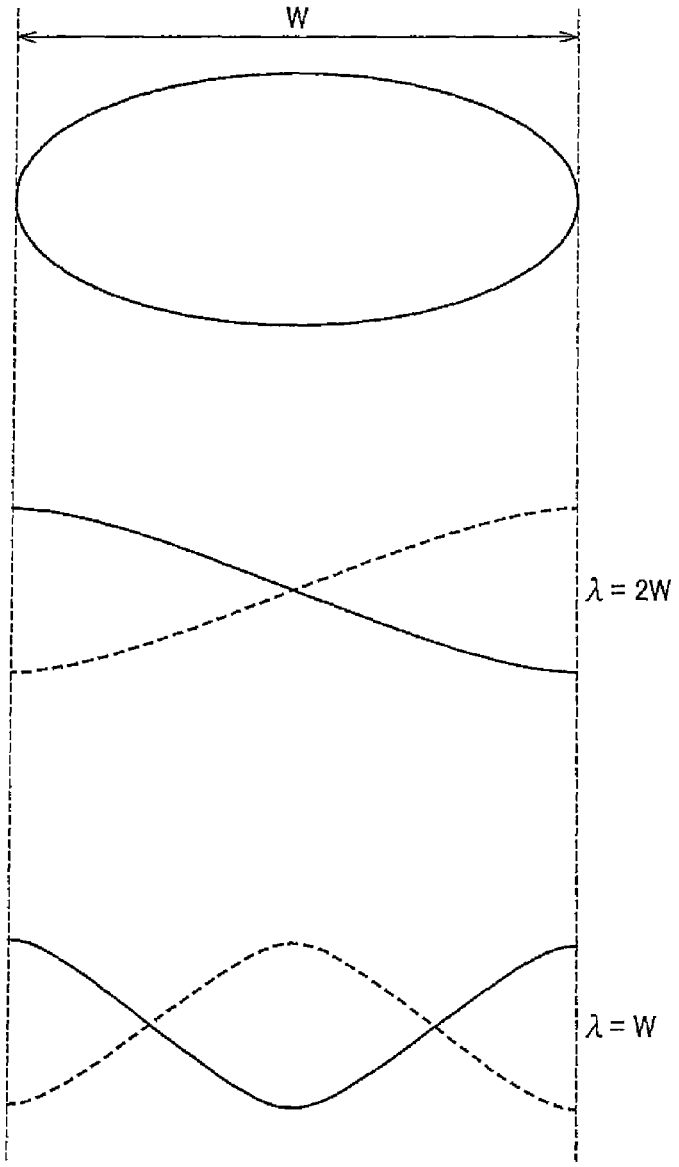
FIG. 13A is a sectional view showing a sectional elevation structure of a muffler having a flattened sectional shape.
FIGS. 13B and 13C are graphs each showing a waveform of a standing wave that is produced within the structure due to the air column resonance.

As shown in FIG. 12B, the second sound-deadening chamber 44 of the muffler 40 is open to the outside of the second sound-deadening chamber 44 through the first communication pipe 48, at the position that is apart by the length equal to a quarter of the width W of the muffler 40 from the left-side end (FIG. 12B) of the muffler 40 in the width direction. The second sound-deadening chamber 44 is open to the outside of the second sound-deadening chamber 44 through the second communication pipe 49 at the position that is apart by the length equal to a half of the width W of the muffler 40 from the left-side end (FIG. 12B) of the muffler 40 in the width direction.

Furthermore, as shown in FIG. 10C, the third sound-deadening chamber 45 of the muffler 40 is open to the outside of the third sound-deadening chamber 45 through the opening of the distal end of the inlet pipe 46, at the position that is apart by the length equal to a quarter of the width W of the muffler 40 from the right-side end (FIG. 12C) of the muffler 40 in the width direction. The third sound-deadening chamber 45 is open to the outside of the third sound-deadening chamber 45 through the second communication pipe 49, at the position that is apart by the length equal to a half of the width W of the muffler 40 from the right-side end (FIG. 12C) of the muffler 40 in the width direction.

As described above, in this muffler 40, each of the opening of the inlet pipe 46, the opening of the outlet pipe 47, the first communication pipe 48, and the second communication pipe 49 is disposed at either the position that is apart by the length equal to a half of the width W of the muffler 40 from one end of the muffler 40 in the width direction or the position that is apart by the length equal to a quarter of the width W from one end of the muffler 40 in the width direction. In other words, in each of the first to third sound-deadening chambers 43 to 45, at least one among the opening of the inlet pipe 46, the opening of the outlet pipe 47, the communication hole formed by the first communication pipe 48, and the communication hole formed by the second communication pipe 49 is disposed at the position that is apart by the length equal to a half of the width W of the muffler 40 from one end of the muffler 40 in the width direction, and at least one among the opening of the inlet pipe 46, the opening of the outlet pipe 47, the communication hole formed by the first communication pipe 48, and the communication hole formed by the second communication pipe 49 is disposed at the position that is apart by the length equal to a quarter of the width W of the muffler 40 from the same end of the muffler 40 in the width direction. Therefore, in this embodiment, too, the effects described above as (1) to (3) can be achieved.

The following modifications or changes may be made to the foregoing embodiments. The arrangements of the openings of the inlet and outlet pipes and the communication holes may be made different from those in the foregoing embodiments. In such cases as well, it is possible to effectively reduce the exhaust sound caused by the air column resonances in the width direction of the muffler, as long as in each sound-deadening chamber, at least one among the opening of the inlet pipe, the opening of the outlet pipe, and at least one communication hole (opening) is disposed at a position that is apart by a length equal to a half of the width W of the muffler from one end of the muffler in the width direction, and at least one among the opening of the inlet pipe, the opening of the outlet pipe, and at least one communication hole (opening) is disposed at a position that is apart by a length equal to a quarter of the width W of the muffler from the same end in the width direction.

Although in each of the foregoing embodiments, the inside of the muffler is divided into three sound-deadening chambers, the number of sound-deadening chambers formed in the muffler may be appropriately changed. Also, the number of communication pipes and the number of communication holes may be changed. In any case, as long as in each sound-deadening chamber, at least one among the opening of the inlet pipe, the opening of the outlet pipe, and at least one communication hole (opening) is disposed at a position that is apart by a length equal to a half of the width W of the muffler from one end of the muffler in the width direction, and at least one among the opening of the inlet pipe, the opening of the outlet pipe, and at least one communication hole (opening) is disposed at a position that is apart by a length equal to a quarter of the width W of the muffler from the same end in the width direction, it is possible to effectively reduce the exhaust sound caused by the air column resonances in the width direction of the muffler.

Although in the foregoing embodiments, each sound-deadening chamber is formed so that the length thereof in the fore-aft direction of the muffler is greater than or equal to a quarter of the width W of the muffler, one or more or all of the sound-deadening chambers may be formed so that the length of each of the sound-deadening chambers in the fore-aft direction of the muffler is less than a quarter of the width W of the muffler.

In the foregoing embodiments, in each sound-deadening chamber, at least one among the opening of the inlet pipe, the opening of the outlet pipe, and at least one communication hole (opening) is disposed at a position that is apart by a length equal to a half of the width W of the muffler from one end of the muffler in the width direction, and at least one among the opening of the inlet pipe, the opening of the outlet pipe, and at least one communication hole (opening) is disposed at a position that is apart by a length equal to a quarter of the width W of the muffler from the same end in the width direction. However, if in at least one sound-deadening chamber, the air column resonance in the width direction of the muffler does not conspicuously appear, the arrangement of openings and communication holes in the at least one sound-deadening chamber may be made different from the above-described arrangements thereof.

The invention claimed is:

1. A silencing apparatus for a vehicle, comprising:

a muffler having a flattened sectional shape in which a width is greater than a height, an interior of the muffler provided with a first partition plate and a second partition plate that divide the interior of the muffler into a first sound deadening chamber, a second sound deadening chamber, and a third sound deadening chamber disposed in a fore aft direction of the muffler;

an inlet pipe through which exhaust gas flows into an inside of the muffler, the inlet pipe disposed at a position that is apart by a length equal to a quarter width of the muffler from a first side end of the muffler in a width direction of the muffler, a distal end of the inlet pipe provided with an opening into the third sound deadening chamber;

an outlet pipe through which the exhaust gas flows out of the inside of the muffler;

the outlet pipe disposed at a position that is apart by a length equal to a half width of the muffler from the first side end of the muffler in the width direction of the muffler, a distal end of the outlet pipe provided with an opening into the first sound deadening chamber;

the first partition plate is provided with a first communication pipe that extends through the first partition plate at a position that is apart by a length equal to a quarter width of the muffler from a second side end of the muffler in the width direction;

the second partition plate is provided with a second communication pipe that extends through the second partition plate and is disposed at the position that is apart by a length equal to a half width of the muffler from the first side end of the muffler in the width direction;

the first and the second communication pipes form a first communication hole that extends through the first partition plate and a second communication hole that extends through the second partition plate, respectively; and wherein the first sound deadening chamber is open to an outside of the first sound deadening chamber through the first communication pipe at a position set apart by a length equal to a quarter width of the muffler from the second side end of the muffler in a width direction, the first sound deadening chamber is at a position set apart by a length equal to a half of the width of the muffler from the second side end of the muffler in a width direction, the second sound deadening chamber is open to an outside of the second sound deadening chamber through the first communication pipe disposed at a position set apart by a length equal to a quarter width of the muffler from the second side end of the muffler in a width direction, the second sound deadening chamber is open to the outside of the second sound deadening chamber through the second communication pipe disposed at a position set apart by a length equal to half the width of the muffler from the second side end of the muffler in a width direction, and the third sound deadening chamber is open to an outside of the third sound deadening chamber through an opening of the distal end of the inlet pipe at a position set apart by a length equal to a quarter width of the muffler from the first side end of the muffler in a width direction, the third sound deadening chamber is open to an outside of the third sound deadening chamber through the second communication pipe at a position set apart by a length equal to half the width of the muffler from the first side end of the muffler in a width direction.

2. The silencing apparatus according to claim 1, wherein in the fore-aft direction of the muffler, the inside of the muffler is divided by the at least one partition plate into the first, second and third sound-deadening chambers each of which has a length in the fore-aft direction of the muffler, which is greater than or equal to a quarter of the width of the muffler.

3. The silencing apparatus according to claim 1, wherein the outlet pipe does not open into the second sound-deadening chamber.

4. A silencing apparatus for a vehicle, comprising:

a muffler having a flattened sectional shape in which a width is greater than a height, an interior of the muffler provided with a first partition plate and a second partition plate that divided the interior into a first sound deadening chamber, a second sound deadening chamber, and a third sound deadening chamber disposed in a fore-aft direction of the muffler;

an inlet pipe through which exhaust gas flows into an inside of the muffler, the inlet pipe disposed at a position that is apart by a length equal to a half width of the muffler from a first side end of the muffler in a width direction of the muffler, a distal end of the inlet pipe is provided with an opening in the third sound deadening chamber;

an outlet pipe through which the exhaust gas flows out of the inside of the muffler;

the outlet pipe disposed at a position that is apart by a length equal to a half width of the muffler from the first side end of the muffler in a width direction of the muffler, a distal end of the outlet pipe is provided with an opening in the first sound deadening chamber;

the first partition plate is provided with a first communication pipe that extends through the first partition plate at a position that is apart by a length equal to a quarter width of the muffler from the first side end of the muffler in the width direction;

a second communication pipe extends through the second partition plate and is disposed at a position that is apart by a length equal to a quarter width of the muffler from the first side end of the muffler in the width direction;

the first and second communication pipes form a first communication hole that extends through the first partition plate and a second communication hole that extends through the second partition plate, respectively;

the first sound deadening chamber is open to the outside of the first sound deadening chamber through the first communication pipe disposed at a position that is apart by a length equal to a quarter width of the muffler from a first side end of the muffler in a width direction, the first sound deadening chamber is open to the outside of the first sound deadening chamber through an opening of the distal end of the outlet pipe disposed at a position that is apart by a length equal to half the width of the muffler from the first side end of the muffler in the width direction, the second sound deadening chamber is open to the outside of the second sound-deadening chamber through the first communication pipe and the second communication pipe disposed at a position that is apart by a length equal to a quarter width of the muffler from the first side end of the muffler in the width direction, the second sound deadening chamber is open to the outside of the second sound deadening chamber via a plurality of small openings formed on a side peripheral wall of the outlet pipe at a position disposed by a length equal to half the width of the muffler from the first side end of the muffler in the width direction, the third sound deadening chamber is open to the outside of the third sound deadening chamber through the second communication pipe disposed at a position that is apart by a length equal to a quarter width of the muffler from the first side end of the muffler in the width direction, the third sound deadening chamber is open to the outside of the third sound deadening chamber through an opening of the distal end of the inlet pipe disposed at a position that is apart by a length equal to half the width of the muffler from the first side end of the muffler in the width direction.

5. A silencing apparatus for a vehicle, comprising:

a muffler having a flattened sectional shape in which a width is greater than a height, an interior of the muffler provided with a first partition plate and a second partition plate that divided the interior into a first sound deadening chamber, a second sound-deadening chamber, and a third sound deadening chamber disposed in a fore aft direction of the muffler;

an inlet pipe through which exhaust gas flows into an inside of the muffler, the inlet pipe disposed at a position that is apart by a length equal to a half width of the muffler from a first side end of the muffler in a width direction of the muffler, a distal end of the inlet pipe is provided with an opening in the third sound deadening chamber;

an outlet pipe, through which the exhaust gas flows out of the inside of the muffler; the outlet pipe disposed at a position that is apart by a length equal to a quarter width of the muffler from a second side end of the muffler in a width direction of the muffler, a distal end of the outlet pipe is provided with an opening in the first sound deadening chamber;

the first partition plate is provided with a first communication pipe that extends through the first partition plate disposed at a position that is apart by a length equal to a half width of the muffler from the first side end of the muffler in the width direction;

a second communication pipe extends through the second partition plate and is disposed at a position that is apart by a length equal to a quarter width of the muffler from the first side end of the muffler in the width direction;

the first and second communication pipes form a first communication hole that extends through the first partition plate and a second communication hole that extends through the second partition plate, respectively;

the first sound deadening chamber is open to the outside of the first sound deadening chamber through the opening of the distal end of the outlet pipe at a position that is apart by a length equal to a quarter width of the muffler from the second side end of the muffler in a width direction, the first sound deadening chamber is open to the outside of the first sound deadening chamber through the first communication pipe at a position that is apart by a length equal to half the width of the muffler from the second side end of the muffler in the width direction, the second sound deadening chamber is open to the outside of the second sound deadening chamber through the second communication pipe disposed at a position that is apart by a length equal to a quarter width of the muffler from the first side end of the muffler in the width direction, the second sound deadening chamber is open to the outside of the second sound-deadening chamber through the first communication pipe disposed at a position that is apart by a length equal to half the width of the muffler from the first side end of the muffler in the width direction, the third sound deadening chamber is open to the outside of the third sound deadening chamber through the second communication pipe disposed at a position that is apart by a length equal to a quarter width of the muffler from the first side end of the muffler in the width direction, the third sound deadening chamber is open to the outside of the third sound deadening chamber through an opening of the distal end of the inlet pipe at a position disposed by a length equal to half the width of the muffler from the first side end of the muffler in the width direction.

* * * * *